US005834738A

United States Patent [19]

Wilson

[11] Patent Number: 5,834,738

[45] Date of Patent: Nov. 10, 1998

[54] HEATED GOLF BAG APPARATUS

[76] Inventor: Michael Wilson, 14 Corbinshaw Rd, Churchill Pk Kings Lynn, Norfolk, United Kingdom, PE30 4UL

[21] Appl. No.: 783,346

[22] Filed: Jan. 16, 1997

[51] Int. Cl.[6] ..... A21B 1/00

[52] U.S. Cl. ..... 219/400; 219/386; 219/387; 206/315.3; 392/384

[58] Field of Search ..... 219/400, 385, 219/386, 387; 206/315.3, 315.2, 315.5; 392/384, 383

[56] References Cited

U.S. PATENT DOCUMENTS

| | | | |
|---|---|---|---|
| 3,707,279 | 12/1972 | Kaiser | 219/521 |
| 4,042,918 | 8/1977 | Klitzman | 340/280 |
| 4,849,610 | 7/1989 | Alvarez | 219/521 |
| 4,904,847 | 2/1990 | Kosaka | 692/384 |
| 4,910,385 | 3/1990 | Shye-Long | 392/384 |
| 4,967,062 | 10/1990 | Cohen | 219/386 |
| 5,028,909 | 7/1991 | Miller | 340/568 |
| 5,062,528 | 11/1991 | Whitaker | 219/386 |
| 5,297,328 | 3/1994 | Reimers | 29/450 |
| 5,341,927 | 8/1994 | Coyner | 219/521 |

FOREIGN PATENT DOCUMENTS

| | | | |
|---|---|---|---|
| 2234912 | 2/1991 | United Kingdom | 219/521 |

*Primary Examiner*—Teresa J. Walberg
*Assistant Examiner*—Quan Nguyen

[57] ABSTRACT

A new Heated Golf Bag Apparatus for heating and drying of the interior of the bag and golfing equipment. The inventive device includes a golf bag having a hollow interior, a heater providing heat to the hollow interior of the bag when activated, a fan circulating air in the hollow interior of the golf bag, a plurality of hollow tubes adapted to accept golf clubs extending into the hollow interior of the golf bag, and a switch in each of the hollow tubes, each switch being able to activate the heater when a golf club is removed and then reinserted into one of the hollows tubes.

7 Claims, 3 Drawing Sheets

HEATED GOLF BAG APPARATUS

BACKGROUND OF THE INVENTION

1. Field of the Invention

The present invention relates to golf bags and more particularly pertains to a new Heated Golf Bag Apparatus for heating and drying of the interior of the bag and golfing equipment.

2. Description of the Prior Art

The use of golf bags is known in the prior art. More specifically, golf bags heretofore devised and utilized are known to consist basically of familiar, expected and obvious structural configurations, notwithstanding the myriad of designs encompassed by the crowded prior art which have been developed for the fulfillment of countless objectives and requirements.

Known prior art golf bags include U.S. Pat. No. 5,341,927; U.S. Pat. No. 5,062,528; U.S. Pat. Des. 348,567; U.S. Pat. No. 5,358,109; U.S. Pat. No. 5,121,739 and U.S. Pat. No. 4,420,681.

While these devices fulfill their respective, particular objectives and requirements, the aforementioned patents do not disclose a new Heated Golf Bag Apparatus. The inventive device includes a golf bag having a hollow interior, a heater providing heat to the hollow interior of the bag when activated, a fan circulating air in the hollow interior of the golf bag, a plurality of hollow tubes adapted to accept golf clubs extending into the hollow interior of the golf bag, and a switch in each of the hollow tubes, each switch being able to activate the heater when a golf club is removed and then reinserted into one of the hollows tubes.

In these respects, the Heated Golf Bag Apparatus according to the present invention substantially departs from the conventional concepts and designs of the prior art, and in so doing provides an apparatus primarily developed for the purpose of heating and drying of the interior of the bag and golfing equipment.

SUMMARY OF THE INVENTION

In view of the foregoing disadvantages inherent in the known types of golf bags now present in the prior art, the present invention provides a new Heated Golf Bag Apparatus construction wherein the same can be utilized for heating and drying of the interior of the bag and golfing equipment.

The general purpose of the present invention, which will be described subsequently in greater detail, is to provide a new Heated Golf Bag Apparatus apparatus and method which has many of the advantages of the golf bags mentioned heretofore and many novel features that result in a new Heated Golf Bag Apparatus which is not anticipated, rendered obvious, suggested, or even implied by any of the prior art golf bags, either alone or in any combination thereof.

To attain this, the present invention generally comprises a golf bag having a hollow interior, a heater providing heat to the hollow interior of the bag when activated, a fan circulating air in the hollow interior of the golf bag, a plurality of hollow tubes adapted to accept golf clubs extending into the hollow interior of the golf bag, and a switch in each of the hollow tubes, each switch being able to activate the heater when a golf club is removed and then reinserted into one of the hollows tubes.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new Heated Golf Bag Apparatus apparatus and method which has many of the advantages of the golf bags mentioned heretofore and many novel features that result in a new Heated Golf Bag Apparatus which is not anticipated, rendered obvious, suggested, or even implied by any of the prior art golf bags, either alone or in any combination thereof.

It is another object of the present invention to provide a new Heated Golf Bag Apparatus which may be easily and efficiently manufactured and marketed.

It is a further object of the present invention to provide a new Heated Golf Bag Apparatus which is of a durable and reliable construction.

An even further object of the present invention is to provide a new Heated Golf Bag Apparatus which is susceptible of a low cost of manufacture with regard to both materials and labor, and which accordingly is then susceptible of low prices of sale to the consuming public, thereby making such Heated Golf Bag Apparatus economically available to the buying public.

Still yet another object of the present invention is to provide a new Heated Golf Bag Apparatus which provides in the apparatuses and methods of the prior art some of the advantages thereof, while simultaneously overcoming some of the disadvantages normally associated therewith.

Still another object of the present invention is to provide a new Heated Golf Bag Apparatus for heating and drying of the interior of the bag and golfing equipment.

Yet another object of the present invention is to provide a new Heated Golf Bag Apparatus which includes a golf bag having a hollow interior, a heater providing heat to the hollow interior of the bag when activated, a fan circulating air in the hollow interior of the golf bag, a plurality of hollow tubes adapted to accept golf clubs extending into the hollow interior of the golf bag, and a switch in each of the hollow tubes, each switch being able to activate the heater when a golf club is removed and then reinserted into one of the hollows tubes.

Still yet another object of the present invention is to provide a new Heated Golf Bag Apparatus that heats and dries the grips of golf clubs.

Even still another object of the present invention is to provide a new Heated Golf Bag Apparatus that maintains golf clubs and associated equipment at an elevated temperature for use during a golf game to maintain efficiency and effectiveness of the equipment.

These together with other objects of the invention along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
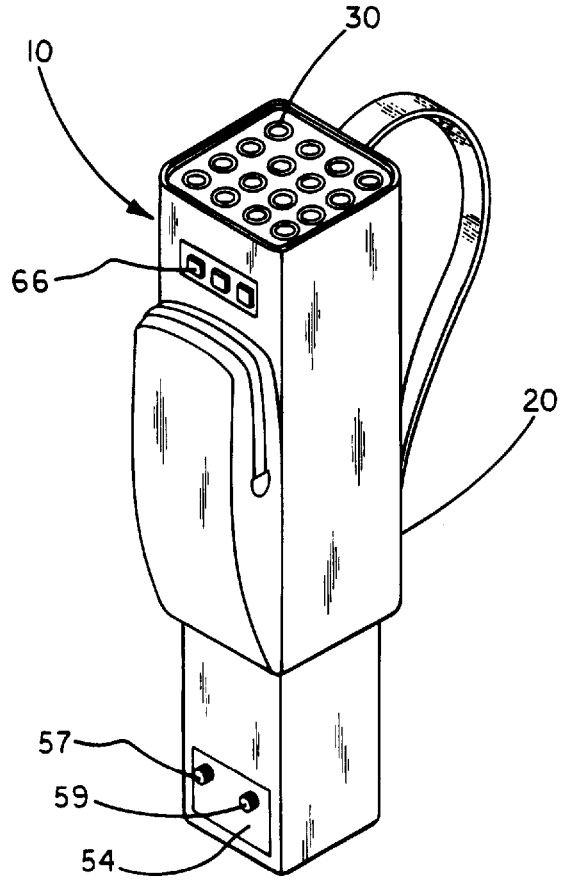
FIG. 1 is a right side perspective view of a new Heated Golf Bag Apparatus according to the present invention.
Figure 2:
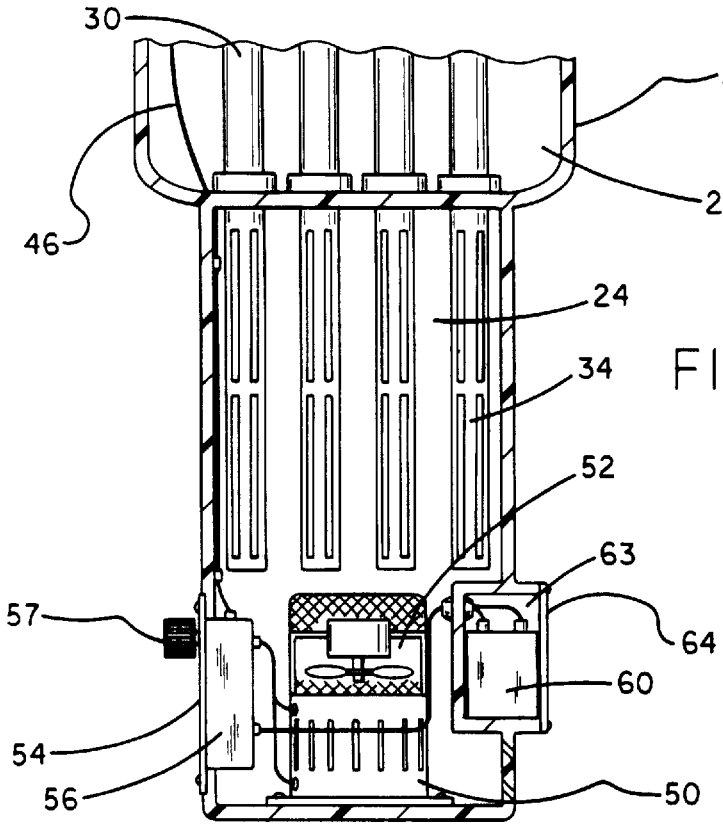
FIG. 2 is a partial sectional side view of the heating means of the invention.
Figure 3:
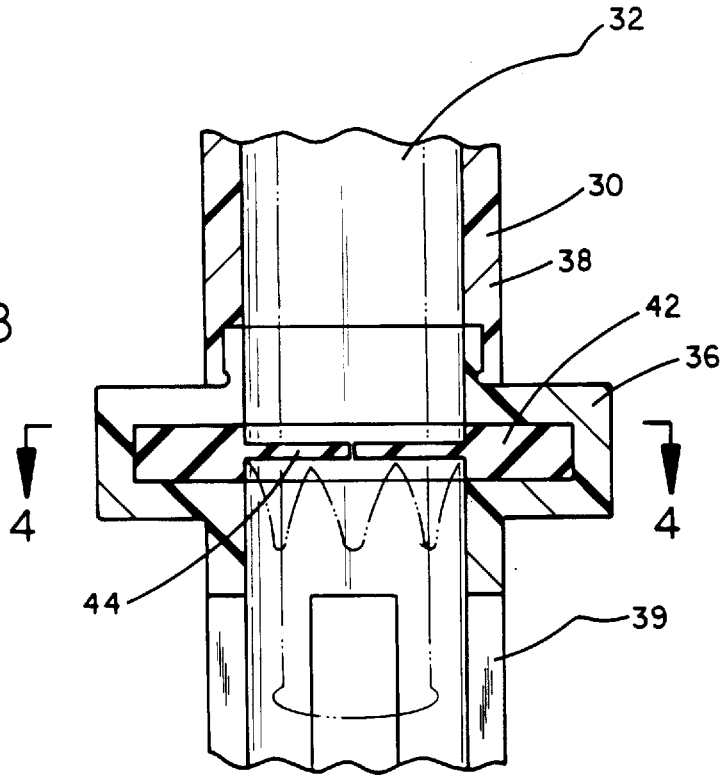
FIG. 3 is a partial sectional side view of the diaphragm portion of the golf club tubes.
Figure 4:
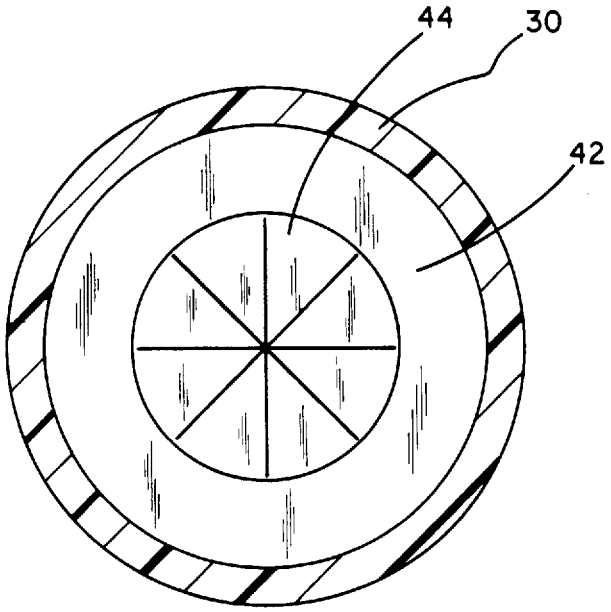
FIG. 4 is a cross sectional view taken along line 4—4 of FIG. 3 showing the diaphragm in a golf club tube.
Figure 5:
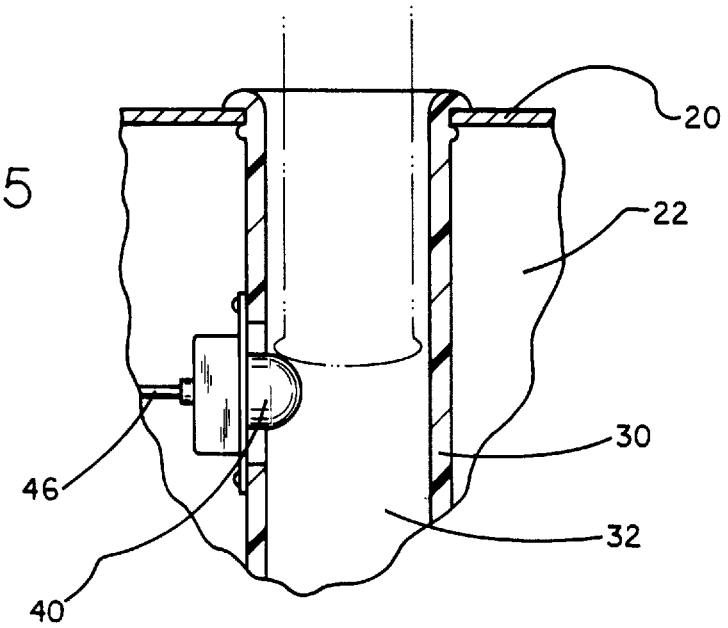
FIG. 5 is a partial sectional side view of the invention showing the upper portion of a golf club tube with the heat switch.
Figure 6:
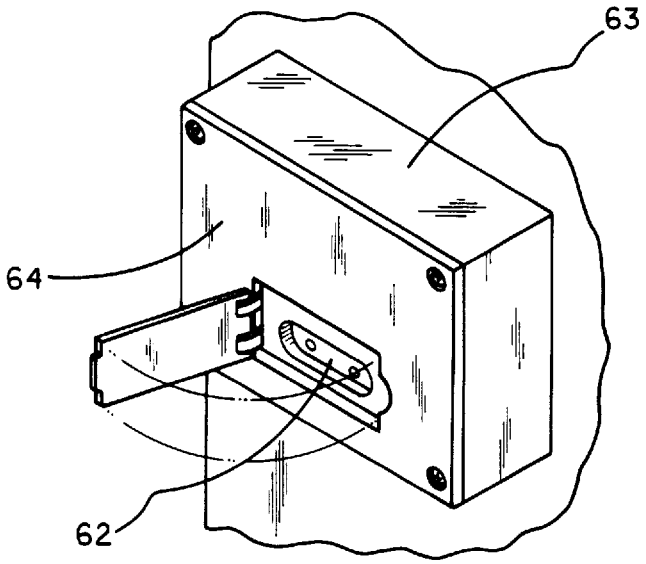
FIG. 6 is a partial perspective view of the invention showing the battery access panel.

With reference now to the drawings, and in particular FIGS. 1 through 6 thereof, a new heated Golf Bag Apparatus embodying the principles and concepts of the present invention and generally designated by the reference numeral 10 will be described.

More specifically, it will be noted that the Heated Golf Bag Apparatus 10 comprises golf bag 20, a heater 50, a fan 52, a plurality of tubes 30, and a plurality of switches 40.

As best illustrated in FIGS. 1 through 6, it can be shown that the golf bag 20 has a hollow golf bag interior 22 which defines a heating chamber 24 at the bottom end of the golf bag 20. The top end of the golf bag 20 is open to allow the insertion of golf clubs 100 into the golf bag interior 22. The golf bag 20 should be made of a material that is adapted for use in a range of weather conditions especially including rainy or damp weather.

An electrical heater 50 is located inside the heating chamber 24 at the bottom end of the golf bag 20. When activated, the heater 50 provides heat to the heating chamber 24. An electrical fan 52 is also located in the heating chamber 24 to provide air circulation to the heating chamber 24. The heater 50 and the fan 52 provide heat and air circulation to the heating chamber 24 in order to heat and dry the grips and shafts of golf clubs inserted into the golf bag 20.

A plurality of tubes 30 are disposed in the golf bag interior 22 with their top ends extending towards the open top end of the golf bag 20 and their bottom ends extending into the heating chamber 24. The tubes 30 each have a hollow tube interior 32 and their top ends are open and adapted to accept golf club shafts into their hollow tube interiors 32.

The bottom ends of the tubes 30 have a plurality of heating slots 34 disposed within the heating chamber 24. The heating slots 34 provide bottom openings into the hollow tube interiors 24. The heating slots 34 allow heat and air to circulate into the hollow tube interiors 32 from the heating chamber 24 to warm and dry golf clubs inserted into the tubes 30.

The heated golf bag apparatus also includes a plurality of switches 40. These switches 40 activate the heater 50. A switch 40 is disposed in each hollow tube interior 32. Each switch 40 is adapted to engage a golf club being inserted into the hollow tube interior 32. Each switch 40 is operatively connected to the heater 50 by wires 46. The switches 40 are designed to activate the heater 50 when a golf club is first removed and then reinserted into the same tube 30.

A diaphragm 42 is disposed within each of the hollow tube interiors 32 in a diaphragm mount 36 included in each of the tubes 30 at a point between the top end of the tube 30 and the heating slots 34. Optionally, the tubes 30 can be made up of a upper tube 38 and a lower tube 39 connected by a separate diaphragm mount 36 for easier manufacturing. The diaphragms 42 are adapted to allow a golf club shaft to pass through them and include a series of radially inwardly directed flexible protrusions 44 for engaging a golf club shaft passing through the diaphragm 42. The diaphragms 42 and their flexible protrusions 44 provide a barrier to heat passing upwardly through the parts of the tubes 30 not in the heating chamber 24.

The heater 50 and the fan 52 are powered by a battery 60 disposed in a battery compartment 63 having a battery access panel 64 included on the golf bag 20. The battery 60 may also be rechargeable and include a recharge socket 62 for plugging the battery 60 into a household AC power outlet via a detachable power cord.

The Heated Golf Bag Apparatus 10 may also have a control box 54 wired to the heater 50 and fan 52. The control box 54 includes a timer 58 to control the length of time said heater 50 is activated and a thermostat 56 to control the temperature of the heat the heater 50 provides. A timer knob 59 and a thermostat knob 57 on the outside of the golf bag 20 allow adjustment of the timer 58 and thermostat 56. The control box 54 may also include power switches 66 on the outside of the golf bag 20 to turn the fan 52 and heater 50 on and off independent of the switches 40 in the tubes 30.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A heated golf bag apparatus comprising:

(a) a golf bag having a hollow golf bag interior, an open top end, and a bottom end;

(b) a heater being disposed within said hollow golf bag interior, and being positioned toward said bottom end of said golf bag;

(c) a fan disposed within said hollow golf bag interior and being positioned toward said bottom end of said golf bag, said fan circulating air within said hollow golf bag interior;

(d) a plurality of tubes having a hollow tube interior, an open top end, and an open bottom end, said tubes being disposed in said hollow golf bag interior, said open bottom ends of said tube extending towards said bottom end of said golf bag, said open top end of said tubes extending towards said open top end of said golf bag, said tubes being adapted to accept a golf club into said hollow tube interior from said open top end of said tubes; and (e) a plurality of switches being operatively connected to said heater, at least one of said switches being disposed in each of said hollow tube interiors, said switches being adapted to engage a golf club being accepted by one of said tubes, said switches activating said heater when a golf club is removed and then reinserted into the same said tube, said heater providing heat to said hollow interior of said golf bag when activated by said switches.

2. The heated golf bag apparatus of claim 1, further comprising a timer being operatively coupled to said heater, said timer controlling the length of time said heater is activated.

3. The heated golf bag apparatus of claim 1, further comprising a thermostat being operatively coupled to said heater, said thermostat controlling the temperature of the heat said heater provides.

4. The heated golf bag apparatus of claim 1, further comprising a battery being operatively coupled to said heater and being operatively coupled to said fan, said battery powering said heater and said fan.

5. The heated golf bag apparatus of claim 4, wherein said battery being rechargeable.

6. A heated golf bag apparatus comprising:

(a) a golf bag having a hollow golf bag interior, an open top end, and a bottom end, said bottom end defining a heating chamber;

(b) a heater being disposed within said heating chamber;

(c) a fan disposed within said heating chamber, said fan circulating air within said heating chamber;

(d) a plurality of tubes having a hollow tube interior, an open top end, and an open bottom end, said bottom end having a plurality of heating slots, said tubes being disposed in said hollow golf bag interior, said open bottom end of said tubes extending into said heating chamber, said heating slots on said bottom end of said tubes disposed within said heating chamber, said heating slots thereby permitting heat and air to circulate into said hollow tube interior from said heating chamber, said open top end of said tubes extending towards said open top end of said golf bag, said tubes being adapted to accept golf clubs into said hollow tube interior from said open top end of said tubes;

(e) a plurality of switches being operatively connected to said heater, at least one of said switches being disposed in each of said hollow tube interiors, said switches being adapted to engage a golf club being accepted by one of said tubes, said heater providing heat to said heating chamber when activated by said switches, said switches activating said heater when a golf club is removed and then reinserted into the same said tube;

(f) a timer being operatively coupled to said heater, said timer controlling the length of time said heater is activated;

(g) a thermostat being operatively coupled to said heater, said thermostat controlling the temperature of the heat said heater provides;

(h) a battery being operatively coupled to said heater and being operatively coupled to said fan, said battery powering said heater and said fan; and (i) a diaphragm being disposed within of said hollow tube interior of said tubes at a point between said open top end of said tubes and said heating slots of said bottom end of said tubes; said diaphragm being adapted to allow golf clubs to pass through said diaphragm, said diaphragm having a series of radially inwardly directed flexible protrusions for engaging a golf club passing through said diaphragm and providing a barrier to heat passing upwardly through said tubes.

7. The heated golf bag apparatus of claim 6, wherein said battery is rechargeable.

* * * * *